United States Patent [19]

Robbins

[11] Patent Number: 4,828,567

[45] Date of Patent: May 9, 1989

[54] DYE SETTING STEAM CHAMBER APPARATUS AND METHOD

[76] Inventor: Ronald B. Robbins, 619 Meadowbrooke Ct., Duncanville, Tex. 75137

[21] Appl. No.: 104,681

[22] Filed: Oct. 5, 1987

[51] Int. Cl.[4] ..... D06B 11/00; D06B 23/18

[52] U.S. Cl. ..... 8/149.3; 68/5 C; 68/5 E

[58] Field of Search ..... 8/149.3, 476; 68/5 C, 68/5 E, 6, 222, 240; 223/70, 73, 76, 79

[56] References Cited

U.S. PATENT DOCUMENTS

| | | | |
|---|---|---|---|
| 56,697 | 7/1866 | Brown | 8/149.3 X |
| 1,198,373 | 9/1916 | Olson | 8/149.3 X |
| 1,326,982 | 1/1920 | Spencer | 68/240 X |
| 1,785,619 | 12/1930 | Easton, Jr. | 68/6 |
| 2,254,691 | 9/1941 | MacLelland, Jr. | 68/240 X |
| 3,330,451 | 7/1967 | Gordon | 68/6 X |
| 3,761,977 | 10/1983 | Rappoport | 8/149.3 |
| 4,083,205 | 4/1978 | Clarke et al. | 68/5 C |
| 4,421,794 | 12/1983 | Kinsley, Jr. | 8/149.3 X |

FOREIGN PATENT DOCUMENTS

| | | | |
|---|---|---|---|
| 530724 | 7/1955 | Italy | 68/240 |
| 588526 | 2/1959 | Italy | 68/6 |
| 1229792 | 4/1971 | United Kingdom . | |

*Primary Examiner*—Philip R. Coe

*Attorney, Agent, or Firm*—Litman, McMahon & Brown

[57] ABSTRACT

A dye setting apparatus for use with carpets, mats and the like comprises a cover having a generally planar interior surface pivotally connected to a support surface. The cover includes a steam containment and support structure having an interior channel flow connected to a steam source. The cover, support structure and support surface form a confinement chamber for the carpet. Steam is released into the chamber from apertures in the support structure to set dye in the carpet. The interior surface of the cover is constructed of a material which is generally non-heat conductive and somewhat water absorbent, such as plywood, to prevent steam from condensing as droplets on the interior of the cover and dropping on the carpet during dye setting.

11 Claims, 2 Drawing Sheets

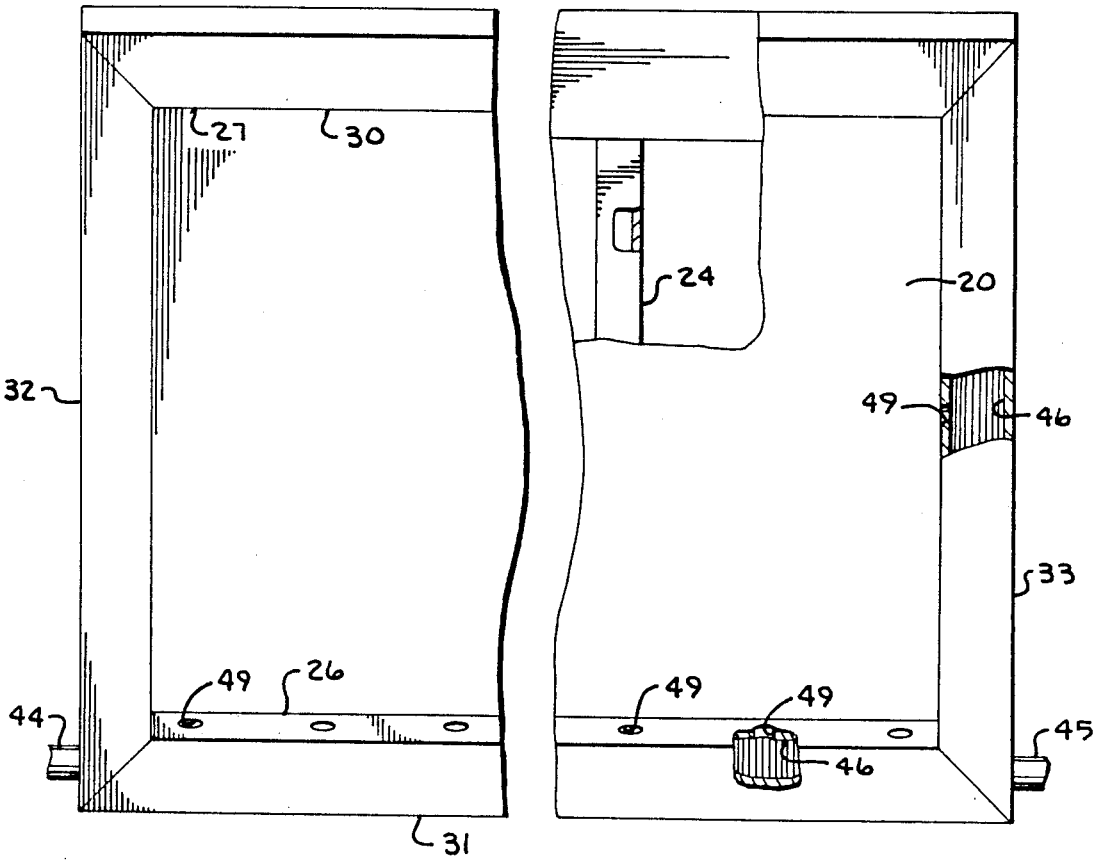
Fig. 4.
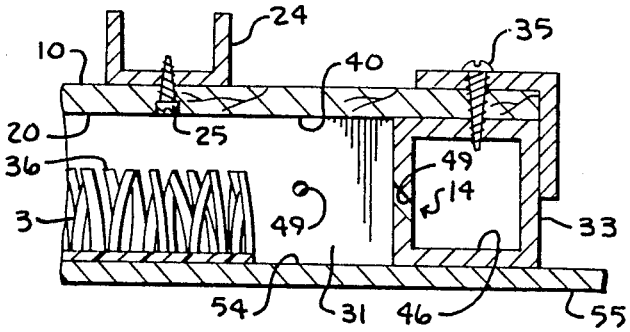
Fig. 5.
Fig. 6.
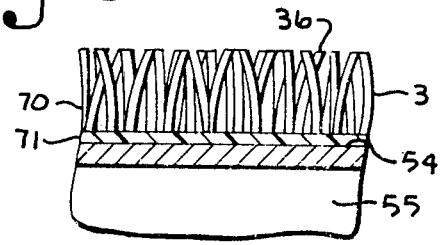

DYE SETTING STEAM CHAMBER APPARATUS AND METHOD

BACKGROUND OF THE INVENTION

The present invention relates to devices for setting dyes in a fabric material and, in particular, to setting dyes by the application of steam heat in carpets, mats and the like, especially carpets having rubber or vinyl backing.

Large, cumbersome steam cabinets have been used for many years to heat dye placed in designs on the surface of carpets and mats, such that the dye is set in the fabric and, thereafter, not substantially removed or displaced by washing or the like. The conventional cabinets have been quite large, taking a substantial amount of space, and typically require a relatively large source of steam, for example a full-size steam boiler. These conventional cabinets are designed to remain in a fixed position and are mobile only upon substantial disassembly. That is, the conventional cabinets are not usable at multiple locations without a great deal of work and effort. These cabinets would definitely not be considered portable in the normal sense of the word.

Historically, these conventional steam cabinets have included some type of conveyor system which transports carpets or the like with dye positioned on the surface thereof through the cabinet during which the carpet is heavily infused with steam to heat it and set the dye. Because of the substantial amount of steam used, the rubber or vinyl backing cannot be added to the carpet in a conventional process until after the dye is set. Otherwise, the backing would become overheated and tend to blister and distort.

In addition, conventional steam cabinets have typically suffered from the problem of steam condensing on the surface of the cabinet above the carpet and subsequently dripping on the carpet, thereby disrupting the dye and distorting the pattern formed. Several attempts have been made to correct this problem in conventional cabinets which have included substantially arcing the upper interior surface of the lid of the cabinets so that condensation runs down arched sides of the lid rather than dripping onto the carpet; however, this makes the interior chamber quite large and inefficient.

Another procedure utilized to avoid water droplets on the roof of the conventional cabinets has been to run an electrical heating element on the inner surface which is designed to evaporate any condensation before it has a chance to form droplets. This extra heating element increases the complexity of the device and adds to the cost of operation of the cabinet.

OBJECTS OF THE INVENTION

Therefore, the objects of the present invention are to provide a dye setting apparatus including a steam diffusion chamber for use in setting dyes in carpets, mats and the like; to provide such an apparatus which is relatively portable; to provide such an apparatus including a cover for forming the steam chamber in cooperation with a lower surface wherein the chamber is entirely enclosed in use, relatively simple in shape and comparatively small in size; to provide such an apparatus wherein the cover has a lower surface constructed of a substantially non-conductive material such as wood, preferably plywood, to reduce the likelihood of condensation of steam by heat transfer between an interior and exterior surface of the cover; to provide such a cover which is substantially absorbent to absorb any moisture condensation which does occur on the surface thereof; to provide such an apparatus having a steam dispersion system to evenly distribute steam without entrained condensation and that collects condensation to return to steam generator; to provide such an apparatus which is relatively simple to use, inexpensive to produce and which is especially well adapted for the intended usage thereof; and to provide a method of setting dye in a carpet utilizing such an apparatus.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is an enlarged and fragmentary front elevational view of the apparatus.

FIG. 5 is an enlarged and fragmentary cross-sectional view of the apparatus, taken along line 5—5 of FIG. 4, and showing the apparatus in a dye setting orientation thereof.

FIG. 6 is an enlarged and fragmentary cross-sectional view of the table and carpet, taken along line 6—6 of FIG. 1.

DETAILED DESCRIPTION OF THE INVENTION

Figure 1:
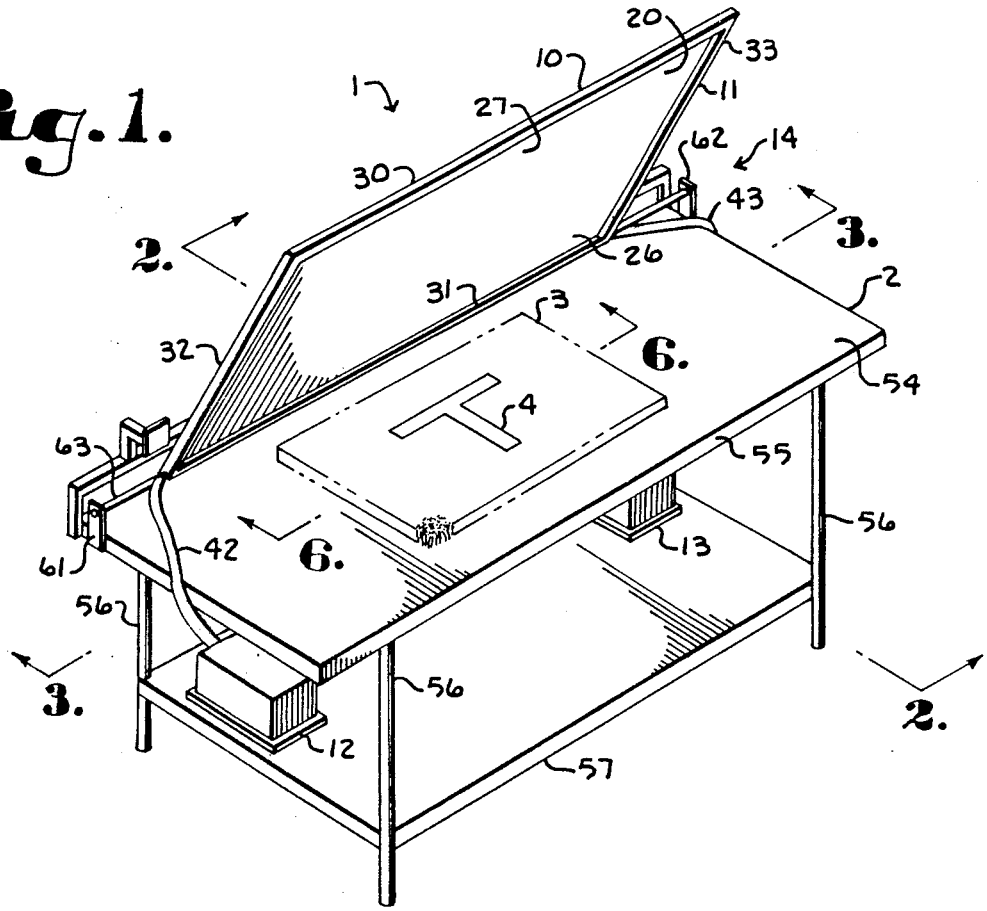
FIG. 1 is perspective view of a dye setting apparatus in accordance with the present invention illustrated in conjunction with a supporting table and showing a carpet with dye thereon to be set by the apparatus, and further showing the apparatus in a non dye setting orientation thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a dye setting apparatus in accordance with the present invention. The apparatus 1 is shown secured to a support table 2 with a carpet 3 having a dye pattern 4 thereon positioned on the table to have the dye pattern 4 set by the apparatus 1.

The apparatus 1 includes a cover 10, steam containment and cover support structure 11, steam generation means, such as steam generators 12 and 13, and a steam distribution system 14.

The apparatus 1 also includes a hingigg mechanism 16 to connect and allow pivotal movement of the cover 10 relative to the table 2.

The cover 10 includes an elongate panel having a substantially planar lower surface 20 having dimensions which are at least as long or greater than the dimensions of the carpet 3. The surface 20 is preferably constructed of a substantially insulative material which will resist the transfer of heat between the surface 20 and an exterior surface 21 of the cover 10. In addition, the surface 20 is also preferably constructed of a material having at least a slight permeability relative to water and having a tendency to absorb small quantities of water. Wood, especially plywood, has been found to be particularly well adapted for construction of the surface 20; however, it is foreseen that other materials could function for this purpose while providing structural support to the cover 10 or alternatively could be structurally supported by other means. When plywood is used, it is preferred that a nonwater soluble glue-type plywood be utilized to prevent sap or resin from being drawn from the interior of the wood by the steam and to prevent disintegration of the wood.

The cover 10 includes a plurality of spaced crossbars 24 secured to the cover 10 by suitable fasteners 25 and constructed of aluminum channels or the like suitable for providing support to the cover 10. The crossbars 24 extend from a rear end 26 of the cover 10 to a front end 27 thereof.

The steam containment and cover support structure 11 comprises a front tube element 30, a rear tube element 31 and side tube elements 32 and 33. The elements 30, 31, 32 and 33 are generally rectangular, and are arranged so as to be joined at respective ends thereof in a rectangular configuration generally outlining the perimeter of the cover 10. The elements 30, 31, 32 and 33 are secured to the cover 10 by suitable fasteners 35 at spaced locations therealong. The width of each of the elements 30, 31, 32 and 33 is sufficient to support the cover 10 in relatively close, but spaced, relationship to an upper surface 36 of the carpet 3 when the apparatus 1 is being utilized to set the dye on the carpet 3, as shown in FIG. 4. Also, as will be discussed hereinafter, the structure 11 generally forms an enclosure or chamber 40 in conjunction with the cover 10 and table 2 when the cover 10 is placed in covering and surrounding relationship to the top 36 and sides of the carpet 3. In particular, the structure 11 extends between the table 2 and the cover 10 when the cover 10 is in covering relationship so as to obstruct or prevent steam from passing from the chamber 40 while dye is being set on the carpet 3. Preferably the cover 10, when in the dye setting orientation thereof (that is when the entire apparatus is in the dye setting orientation thereof), is horizontal and positioned such that the surface 20 is about one to one and a half inches from the carpet top surface. When the apparatus 1 is in the dye setting orientation thereof, as seen in FIG. 5, the bottom of the elements 30, 31, 32 and 33 generally contact and substantially seal with the table 2 so as to form the chamber 40 and prevent steam from escaping to the atmosphere.

The steam generators 12 and 13 are relatively small and portable. Such generators as 12 and 13 are available from various sources, including Jiffy Steamer Company of Union City, Tenn. Each of the steam generators 12 and 13 are attached to a steam output conduit 42 and 43 respectively. The output conduits 42 and 43 are, in turn, flow connected to nipples 44 and 45 respectively attached to side elements 32 and 33 and flow connecting to an interior thereof. The structure 11 includes the elements 30, 31, 32 and 33 joined together to form an interior channel 46. The channel 46 effectively outlines the perimeter of the cover 10 and is flow connected to the nipples 44 and 45 and, consequently, to the steam outputs of the steam generators 12 and 13. The interior surface of each of the elements 30, 31, 32 and 33 adjacent to the chamber 40 each include a plurality of spaced distribution apertures 49 therethrough. The apertures provide flow communication between the channel 46 and the chamber 40 when the apparatus 1 is setting dye on a carpet 3. In this way, steam is allowed to pass from the steam generators 12 and 13 into the chamber 40. Output from the steam generators 12 and 13 can be controlled by switching on the generators 12 and 13 themselves or it is foreseen that such output may also be controlled by a foot treadle or the like.

The apertures 49 are medially positioned between the top and bottom of respective elements 30, 31, 32 and 33 and are angled at approximately forty-five degrees relative to horizontal so as to be lower on the side of the channel 46. In this manner, steam that condenses in the channel 46 is collected beneath the apertures 49 and not directed on the carpet. The apertures 49 also direct the steam to the area above the carpet 3 so that an undue amount of steam does not condense at discrete locations on the carpet 3 directly in front of the apertures 49. The nipples 44 and 45 are positioned near the far back of the cover 10, preferably opening into the interior of the element 31 so that upon raising the cover 10 to a non dye setting orientation, as shown in FIG. 1, any condenses steam in the channel 46 is urged to collect in the element 31 and drain back to the generators 12 and 13 through the nipples 44 and 45 respectively. The elements 30, 31, 32 and 33 are preferably constructed of aluminum, which heats both evenly and quickly when steam is allowed to enter the channel, such that substantial condensation is avoided on the sides of the elements 30, 31, 32 and 33 facing the chamber 40.

The table 2 includes an upper planar surface 54 on a top 55 supported by legs 56. An intermediate shelf 57 is also connected to the legs 56 and utilized herein to support the steam generators 12 and 13. Although the table 2 is illustrated in conjunction with the apparatus 1 in the illustrated embodiment, it is foreseen that the apparatus 1 could be utilized in conjunction with virtually any structure having a substantially planar upper surface, such as 54, capable of supporting the carpet 3 and apparatus 1 and also adapted to seal with the cover support structure 11 when the apparatus 1 is in the due setting orientation thereof to prevent excessive escape of steam.

The hinge mechanism 16 comprises a pair of support struts 61 and 62 secured to opposite sides of the tabletop 55 near the back thereof. An elongate pivot bar 63 extends between the struts 61 and 62 in spaced relationship to the surface 54. Hinge elements 65 are secured to the rear element 31 and cover 10 at the near end 26 thereof, and snugly surround the pivot bar 63 on the other end thereof so as to be pivotable relative thereto and to hold the cover 10 in an open position, as seen in FIG. 1. The hinge mechanism 16 allows the cover 10 to be pivoted upwardly at the front 27 thereof, as is shown in FIG. 1, to allow placement of the carpet 3 in place on the surface 54 for treatment by the apparatus 1 or, alternatively, to allow removal of the carpet 3 from the surface 54 after setting of the dye on the carpet 3. A plurality of cover supports 66 are positioned along the back of the table 2 to support the cover 10 when in an upward position while placing and removing carpets 3 from the table surface 54.

In use, a web or fabric, such as the illustrated carpet 3 is placed on the surface 54. As used herein, the term fabric refers to any material suitable for receiving a dye pattern 4 thereon and having the pattern set by the use of steam heat. Preferably, the fabric is a carpet or mat having an upper pile 70 and a rubber or vinyl preattached backing 71, see FIG. 6. The preferred dye is generally referred to as an acid dye and, in particular, an acid dye suitable for dying synthetic surface fibers used in the construction of carpet topped mats or the like. The dye is placed on the upper surface 36 of the carpet 3. The steam (humid heat rather than dry heat is preferred) is believed to swell the fiber of the carpet 3 and allow the dye 4 to migrate into the pile 70 to set therein. The dye 4 may be placed on the carpet surface 36 by a silkscreen process, airbruhing about a stencil or the like.

After the carpet 3 is in place, as shown in FIG. 1, the cover 10 is closed, as shown in FIG. 5. The generators 12 and 13 are started and steam is applied for sufficient time to allow the dye 4 to set. The carpet, with backing 71 in place, is then removed from the apparatus 1 by raising the cover 10 and manually lifting the carpet 3 from the surface 54.

The channel 46 and conduits are flushed with phosphoric acid or the like on an as-needed basis to remove debris therefrom.

Figure 2:
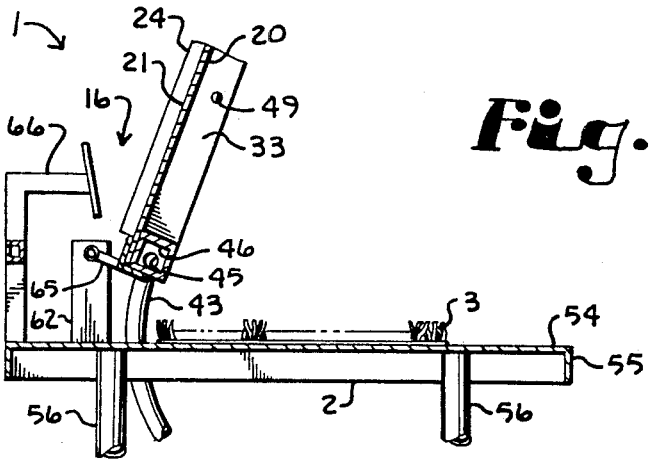
FIG. 2 is an enlarged and fragmentary view of the apparatus, table and carpet, taken generally along line 2—2 of FIG. 1.
Figure 3:
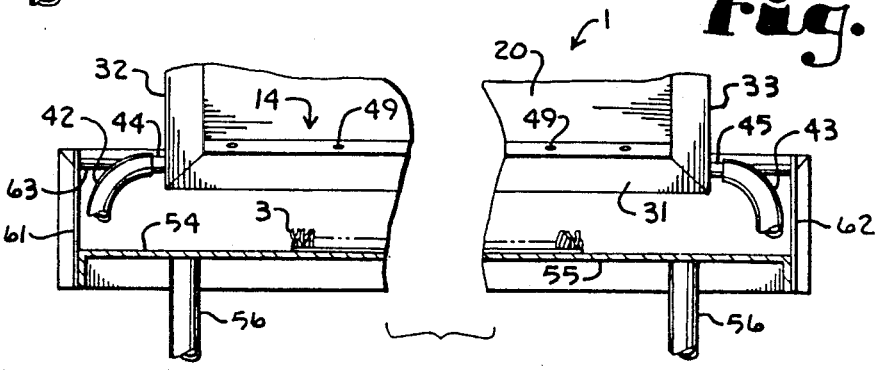
FIG. 3 is an enlarged and fragmentary view of the apparatus, table and carpet, taken generally along line 3—3 of FIG. 1.

It is foreseen within the scope of this invention that the carpet 3 could be both wider and longer than the cover 10, that is, the carpet 3 could be sufficiently large that the cover would not be able to completely enclose the carpet 3. For this purpose, the hinge mechanism operates to lift the cover 10 from engagement with the table surface 54 sufficiently to allow passage of the carpet 3 between the lower edge of the cover 10 and the surface 54 when the cover 10 is an open orientation thereof, as is shown in FIG. 2. In this manner, carpets which are larger than the cover 10 can be positioned beneath the cover 10 such that the cover support structure 11 rests on the upper surface of the carpet, rather than on the table surface 54 in such a manner as to generally form the steam containment chamber 40 with the carpet functioning to prevent excessive passage of steam from beneath the cover 10. It is further noted that the struts 61 and 62, as well as the legs of the cover support 66 are sufficiently spaced so as to allow passage of a relatively long mat or carpet which is substantially as wide as the table 2 to pass from behind the table 2 and beneath the cover 10 when the cover 10 is in the open orientation thereof. This spacing can be seen in FIG. 3. This spacing allows carpets or mats of virtually any length to be passed in sequential segments beneath the cover 10 so as to allow the apparatus 1 to set dye positioned on any such segments.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for setting dye in a dye receiving fabric material by use of steam heat comprising:

(a) a cover adapted to be placed in covering and surrounding relationship to the dye on the fabric so as to form a chamber with the fabric therein;

(b) steam generation means;

(c) means for conveying steam produced by said steam generation means to said chamber when said cover is in a dye setting orientation thereof;

(d) said cover having an interior surface constructed of material substantially resistant to transfer of heat;

(e) securing and hinge means comprising securing means and hinge means; said securing means for securing said cover to a planar surface used to provide support for the fabric to by dyed; and (f) said hinge means connecting said cover at one end thereof to said securing means and allowing said cover to rotate froma covering position to an open position; said hinge means including spacing structure such that, when said cover is in the open position theeeof, said hinge means spaces the end of said cover connected to said hinge means above the planar surface allowing fabric to pass unobstructed between the surface and said cover thereby allowing said apparatus to set dye on materials larger than said apparatus and said spacing structure being positioned such that, when said cover is in the covering position thereof over a fabric, said cover substantially seals to form the chamber about the dye to be set on the bavric so as to provide for maintenance of steam from said steam generation means about the dye to be set.

2. An apparatus for setting dye in a dye receiving fabric comprising:

(a) a generally planar support surface adapted to support the fabric;

(b) a cover adapted to be placed in a covering position thereof so as to be in covering and surrounding relationship to the dye on the fabric supported by said surface so as to form a chamber with the dye to be set therein;

(c) hinge and support means including hinge means and support structure; said hinge means connecting one end of said cover to said surface and allowing said cover to rotate from the covering position thereof to an open position; said hinge means including spacing structures such that, when siad cover is in the open position thereof, said hinge means spaces the end of said cover connected to said hinge means above said surface so as to allow the fabric to pass unobstructed between said surface and said cover, thereby allowing said apparatus to set dye on materials larger than said cover;

(d) steam generation means;

(e) flow connection means for connecting said steam generation means to said chamber when said cover is in the covering position thereof; and (f) said support structure for supporting said cover in spaced relationship to said surface; said support structure adapted to contain steam within said chamber when said cover is in the covering position thereof; and said cover having an interior lower surface adapted to be positioned in closely spaced relationship to said fabric when said cover is in the covering position thereof.

3. A method of setting dye on a dye receiving fabric material comprising the steps of:

(a) placing said fabric on a planar surface;

(b) placing a cover in closely spaced relationship over a section of said fabric having dye to be set so as to form a chamber with the fabric therein allowing excess material to extend outwardly from said cover; said cover having a substantially insulative interior surface and being constructed of a substantially water absorbent material;

(c) generating steam;

(d) directing said generated steam to said chamber while said fabric is within said chamber and said cover is in covering relationship to said fabric, thereby setting dye on said fabric (e) removing said cover from said fabric;

(f) moving said fabric over said support surface until another section having dye to be set is positioned so as to be covered when the cover is in a dye setting position;

(g) repeating steps (b) through (f) until all the dye in each section of fabric containing dye has been set.

4. The method according to claim 3 including:

(a) aligning said cover to be generally planar and horizontally aligned when in a dye setting orientation thereof; and (b) constructing said cover from plywood.

5. An apparatus for setting dye in a dye receiving fabric material by use of steam heat comprising:

(a) a cover adapted to be placed in covering and surrounding relationship to the dye on the fabric so as to form a chamber with the fabric therein;

(b) steam generation means;

(c) means for converging steam produced by said steam generation means to said chamber when said cover is in a dye setting orientation thereof;

(d) said cover having an interior surface constructed of material substantially resistent to transfer of heat; and (e) said interior surface of said cover being planar and horizontally aligned when the cover is in the dye setting orientation thereof and constructed of material adapted to absorb a substantial quantity of water condensed thereon.

6. The apparatus according to claim 5 wherein:

(a) the inner surface of said cover is constructed of plywood.

7. An apparatus for setting dye in a dye receiving fabric material by use of steam heat comprising:

(a) a cover adapted to be placed in covering and surrounding relationship to the dye on the fabric so as to form a chamber with the fabric therein;

(b) steam generation means;

(c) means for conveying steam produced by said steam generation means to said chamber when said cover is in a dye setting orientation thereof;

(d) said cover having an interior surface constructed of material substantially resistent to transfer of heat;

(e) said cover including support structure adapted to support said cover in closely spaced relationship to said fabric when in said covering position thereof;

(f) said support structure comprising tubing having an interior channel;

(g) said support structure having a plurality of apertures positioned so as to allow flow between said channel and said chamber when said cover is in the dye setting orientation thereof; and (h) said steam generation means being flow connected with said channel so as to selectively disperse steam through said apertures into said chamber when said cover is in the dye setting orientation thereof.

8. The apparatus according to claim 7 wherein:

(a) said apertures are medially positioned between the top and bottom of said channel such that said channel collects condensate from steam condensed therein.

9. The apparatus according to claim 8 including:

(a) a planar support surface; and wherein (b) said cover is hinged to said support surface so as to rotate about an axis; and (c) said steam generator means is connected to said channels by conduit means which drains condensation to said steam generation means when said cover is rotated such that said interior surface is not substantially horizontally aligned.

10. The apparatus according to claim 8 wherein:

(a) said apertures are nonhorizontally aligned when said cover is in the dye setting orientation thereof such that each side of said apertures associated with said channel is lower than the side of said apertures associated with said chamber.

11. A method of setting dye on a dye receiving fabric material comprising the steps of:

(a) placing said fabric on a planar suface;

(b) placing a cover in closely spaced relationship over said fabric; said cover having a substantially insulative interior surface and being consturcted of a substantially water absorbent material;

(c) generating steam;

(d) directing said generated steam to said chamber while said fabric is within said chamber and said cover is in covering relationship to said fabric, thereby setting dye on said fabric;

(e) said fabric being a mat having a heat sensitive backing; and including the steps of:

(f) directing said steam into said chamber above said mat so as to not directly impinge on said mat.

* * * * *

UNITED STATES PATENT AND TRADEMARK OFFICE

CERTIFICATE OF CORRECTION

PATENT NO. : 4,828,567

DATED : May 9, 1989

INVENTOR(S) : Ronald B. Robbins

It is certified that error appears in the above-identified patent and that said Letters Patent is hereby corrected as shown below:

In Column 3, line 1, delete "hingigg" and insert -- hinging -- therefor.

In Column 5, line 20, delete "airbruhing" and insert -- airbrushing -- therefor.

In Claim 1, paragraph (e), line 4, delete "by" and insert -- be -- therefor.

In Claim 1, paragraph (f), line 3, delete "froma" and insert -- from a -- therefor; in line 6, delete "theeeof" and insert -- thereof -- therefor; in line 15, delete "bavric" and insert -- fabric -- therefor.

In Claim 2, paragraph (c), line 6, delete "siad" and insert -- said -- therefor.

In Claim 5, paragraph (c), line 1, delete "converging" and insert -- conveying -- therefor.

In Claim 11, paragraph (b), line 3, delete "consturcted" and insert -- constructed -- therefor.

Signed and Sealed this

Tenth Day of October, 1989

*Attest:*

DONALD J. QUIGG

*Attesting Officer*

*Commissioner of Patents and Trademarks*